US007328867B1

(12) United States Patent
Lo

(10) Patent No.: US 7,328,867 B1
(45) Date of Patent: Feb. 12, 2008

(54) BLADE FOR A PAPER SHREDDER CUTTING TOOL

(76) Inventor: Emily Lo, No. 18, Lane 20, Hsin Feng Street, Hsin Chuang City., Taipei Shien (TW)

( * ) Notice: Subject to any disclaimer, the term of this patent is extended or adjusted under 35 U.S.C. 154(b) by 0 days.

(21) Appl. No.: 11/365,737

(22) Filed: Feb. 28, 2006

(51) Int. Cl.
*B02C 1/10* (2006.01)

(52) U.S. Cl. ..... 241/295; 241/100; 241/236

(58) Field of Classification Search ..... 241/100, 241/236, 295

See application file for complete search history.

(56) References Cited

U.S. PATENT DOCUMENTS 5,676,321 A * 10/1997 Kroger ..... 241/236

* cited by examiner

*Primary Examiner*—Faye Francis
(74) *Attorney, Agent, or Firm*—Pro-Techtor Int'l Services

(57) ABSTRACT

A blade for a paper shredder cutting tool that includes an improved structure for one of two blades of each cutter of two rotary cutters of a paper shredder cutting tool. A protruding ring protrudes from a rim of a center hole of the blade, and the protruding ring and the blade are formed as an integrated body. The protruding rings not only enable disposition of paper chaff guides, but also will not deform because of thermal expansion and contraction when shredding paper, thereby preventing a gap from forming between the two blades, and thus the occurrence of paper jamming or wedging together of the blades of the upper and lower cutters.

1 Claim, 3 Drawing Sheets

BLADE FOR A PAPER SHREDDER CUTTING TOOL

BACKGROUND OF THE INVENTION (a) Field of the Invention

The present invention relates to a paper shredder cutting tool, and more particularly to a protruding ring protruding from a blade of each of the cutters. The protruding ring not only eliminates the need for spacer materials as used in prior art paper shredders, but also prevents a gap from forming between the two blades of each of the cutters because of thermal expansion and contraction when shredding paper, and thus the occurrence of paper jamming or wedging together of the upper and lower cutters.

(b) Description of the Prior Art

Referring to FIG. 1, which shows a traditional paper shredder cutting tool assembled from two sets of cylindrical rotary cutters 100, 100', each set of which are structured from a plurality of spacers 102 and a shaft 103. Each of the spacers 102 is disposed between adjacent cutters 101, and the shaft 103 runs through the cutters 101 and the spacers 102, thereby assembling and forming the rotary cutters 100, 100'. Moreover, each of the cutters 101 is assembled from two blades 1011, 1012 juxtaposed and joined together. At least one blade tip 1013 is formed on a periphery of each of the two blades 1011, 1012, and a C-shaped paper chaff guide is circumferentially disposed on the spacers 102. Because a majority of the spacers 102 are fabricated from plastic material, when the paper shredder is shredding paper and producing heat, thus, the spacers 102 easily become fatigued and shrink due to thermal expansion and contraction, thereby causing an enlargement in the gap between the adjacent cutters 101, which not only results in paper jamming, but also wedging together of the upper and lower cutters.

SUMMARY OF THE INVENTION

The primary object of the present invention is to provide an improved structure for one of two blades of each cutter of a paper shredder, whereby a protruding ring protrudes from a rim of a polygonal center hole of the blade, and the protruding ring and the blade are formed as an integrated body. The protruding ring is able to replace the plastic spacer of prior art cutting tools, which not only reduces material use and cost, but also the metal manufactured protruding ring will not deform because of thermal expansion and contraction when shredding paper, thereby preventing occurrence of paper jamming or wedging together of the blades of the upper and lower cutters.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
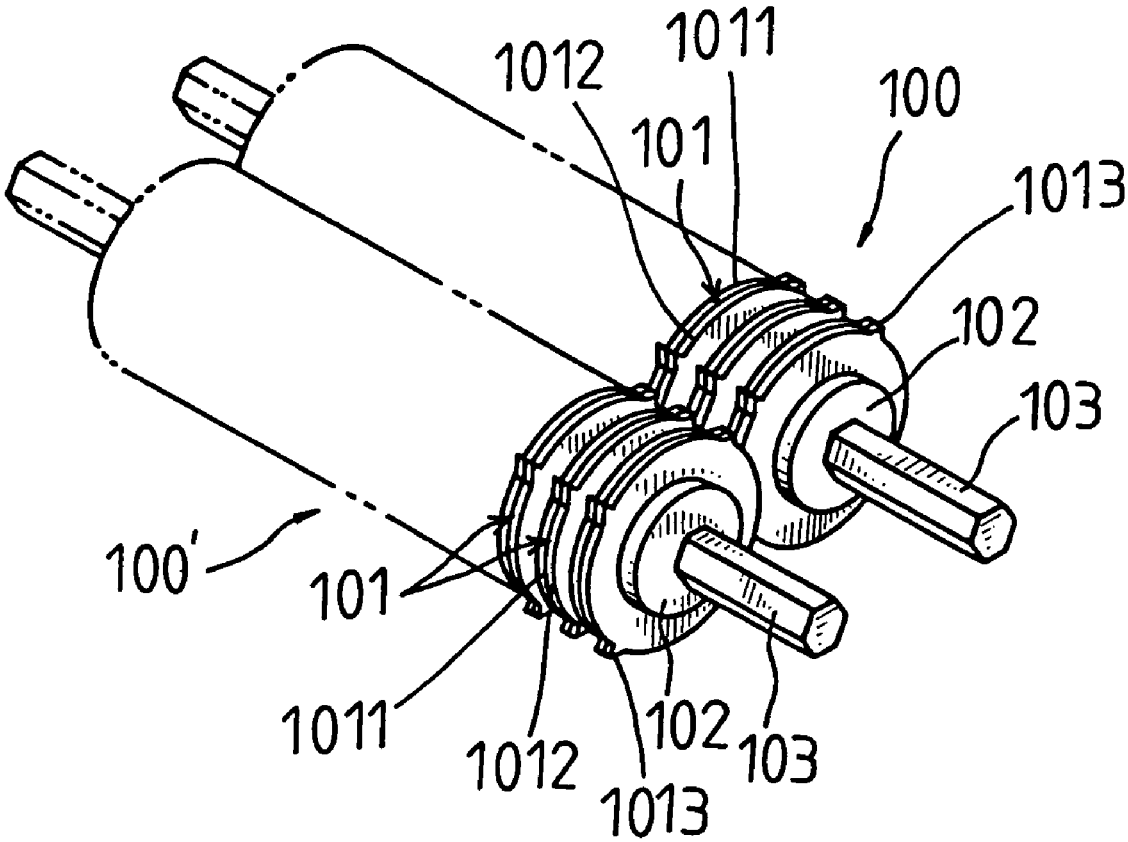
FIG.1 (PRIOR ART)
FIG. 1 shows an external view of a prior art paper shredder cutting tool.
Figure 2:
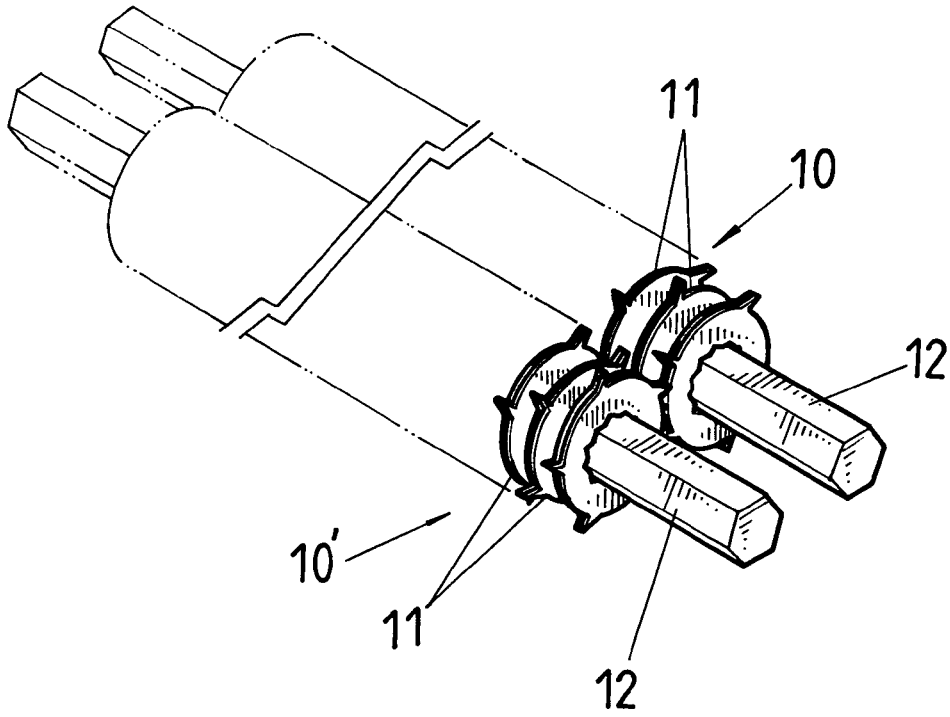
FIG. 2 shows an external view of a paper shredder cutting tool according to the present invention.

Referring to FIG. 2, which shows one embodiment of a paper shredder cutting tool of the present invention, structured to comprise two sets of cylindrical rotary cutters 10, 10', each set of which is structured from a plurality of cutters 11 and a shaft 12. Each of the cutters 11 is assembled from two blades 111, 112 juxtaposed and joined together. At least one blade tip 113 is formed on a periphery of each of the two blades 111, 112.

Figure 3:
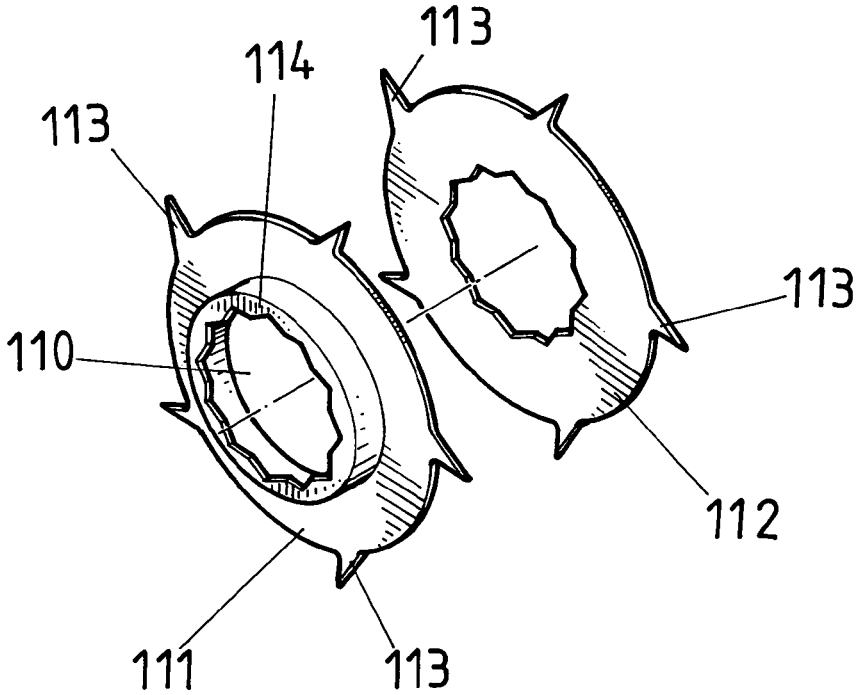
FIG. 3 shows a structural view of a cutter of the paper shredder cutting tool according to the present invention.
Figure 4:
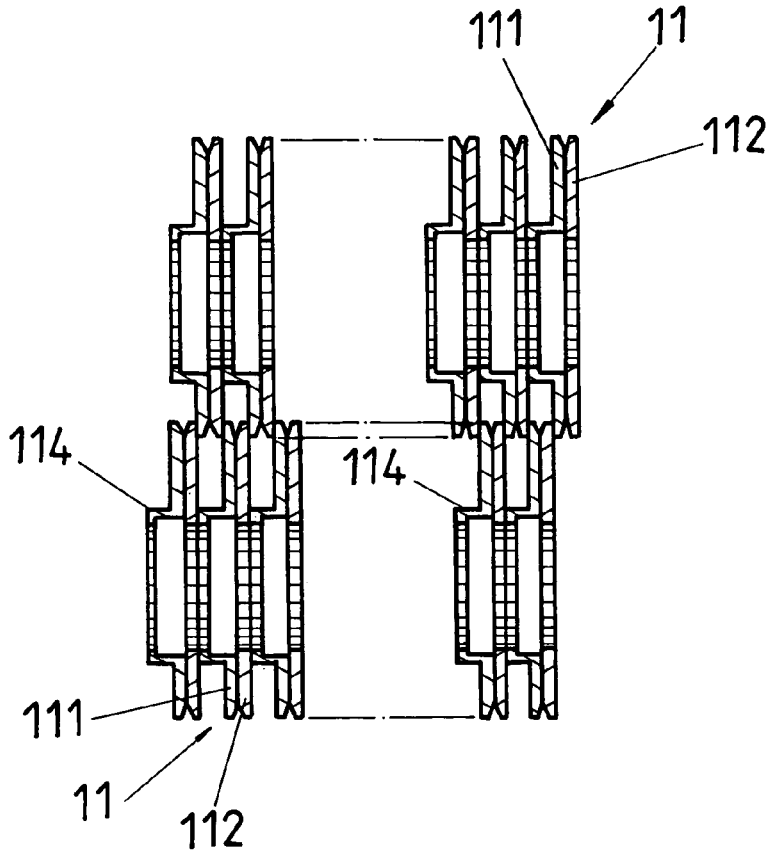
FIG. 4 shows a plane view of an arrangement of the cutters of the paper shredder cutting tool according to the present invention.
Figure 5:
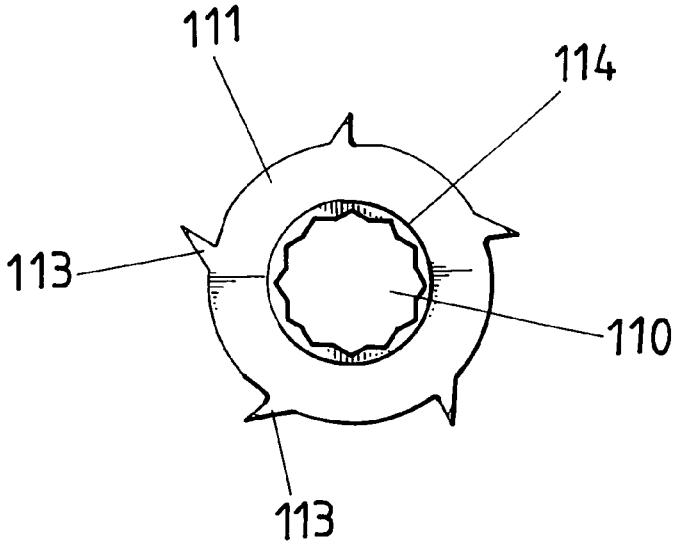
FIG. 5 shows a plane view of blades of a cutter of the paper shredder cutting tool according to the present invention.

Another embodiment of the present invention is characterized in that:

Referring to FIGS. 3, 4 and 5, a protruding ring 114 protrudes from a rim of a polygonal center hole 110 of the blade 111 of each of the cutters 11. The protruding ring 114 and the blade 111 are formed as an integrated body, and a machine punching method can be used to manufacture such an integrated body. The other blade 112 of each of the cutters 11 is similar to one type of traditional blade. In order for the structure of the present invention to have a flat configuration, each of the cutters 11 is assembled by juxtaposed disposition of the two blades 111, 112, as depicted in FIG. 4. Because the protruding ring 114 protruding from each of the blades 111 enables disposition of paper chaff guides, thus, the protruding ring has replaced the plastic spacer of prior art. Moreover, the metal manufactured protruding rings 114 will not deform because of thermal expansion and contraction when shredding paper, thereby preventing the gap between the two blades 111, 112 from enlarging, and thus the occurrence of paper jamming or wedging together of the blades 111, 112 of the upper and lower cutters.

In conclusion, the metal manufactured protruding ring 114 of the present invention has replaced the plastic spacer of prior art. Moreover, the protruding ring 114 protrudes from and is formed as an integrated body with the blade 111 of each of the cutters 11. Hence, the metal manufactured protruding rings 114 not only enable disposition of paper chaff guides, but also will not deform because of thermal expansion and contraction when shredding paper, thereby preventing the gap between the two blades 111, 112 from enlarging, and thus the occurrence of paper jamming or wedging together of the blades 111, 112 of the upper and lower cutters.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A paper shredder cutting tool comprising a first rotary cutter set; and a second rotary cutter set; each of said first rotary cutter set and said second rotary cutter set further comprising a shaft, and a plurality of cutters, each comprising a first blade and a second blade matchingly juxtaposed on said shaft, each of said first blades and said second blades having at least one blade tip formed on a periphery thereof with a center hole adapted to engage said shaft, and each of said first blades having a cylindrical protruding ring extending axially;

wherein said plurality of cutters are disposed with said first blades and said second blades alternatingly arranged on said shafts, and the cutters of said first rotary cutter set are axially offset from the cutters of said second rotary cutter set, allowing said first rotary cutter set and said second rotary cutter set to interpose with the blade tips on said first rotary cutter set aligning with the protruding rings of said second rotary cutter set.

* * * * *